US006195898B1

(12) United States Patent
Lemisch

(10) Patent No.: US 6,195,898 B1
(45) Date of Patent: Mar. 6, 2001

(54) MAGNETICALLY LATCHING BUTTERFLY KNIFE

(76) Inventor: Adam M. Lemisch, 4727 E. Ranch Caliente Dr., Cave Creek, AZ (US) 85331

( * ) Notice: Subject to any disclaimer, the term of this patent is extended or adjusted under 35 U.S.C. 154(b) by 0 days.

(21) Appl. No.: 09/205,820

(22) Filed: Dec. 4, 1998

(51) Int. Cl.[7] ..... B26B 3/06

(52) U.S. Cl. ..... 30/153; 30/157; 30/255; 30/262; 30/340; 7/119; 7/158

(58) Field of Search ..... 30/153, 157, 255, 30/340, 262; 7/119, 158

(56) References Cited

U.S. PATENT DOCUMENTS

| | | | | |
|---|---|---|---|---|
| 229,706 | | 7/1880 | Jansen . | |
| 365,086 | | 6/1887 | Miller . | |
| 881,294 | | 3/1908 | Billings . | |
| 1,270,727 | | 6/1918 | Hanstein . | |
| 1,659,418 | | 2/1928 | Werner . | |
| 1,665,955 | | 4/1928 | Gatewood . | |
| 2,714,249 | | 8/1955 | Clark et al. | 30/153 |
| 4,047,298 | | 9/1977 | Philippar | 30/153 |
| 4,317,284 | * | 3/1982 | Prindle | 30/340 |
| 4,330,937 | | 5/1982 | Cope | 30/153 |
| 4,364,174 | | 12/1982 | De Asis | 30/153 |
| 4,547,965 | | 10/1985 | Moore | 30/153 |
| 4,555,822 | | 12/1985 | Miceli | 7/119 |
| 4,672,743 | | 6/1987 | Grahm | 30/153 |
| 4,693,008 | * | 9/1987 | Velie | 30/390 |
| 4,722,140 | | 2/1988 | Miceli | 30/153 |
| 5,782,001 | * | 7/1998 | Gray | 30/391 |
| 5,806,189 | * | 9/1998 | Bailey | 30/125 |

* cited by examiner

*Primary Examiner*—M. Rachuba
*Assistant Examiner*—Sean Pryor
(74) *Attorney, Agent, or Firm*—Weiss & Moy, P.C.; Jeffrey Weiss; Jeffrey D. Moy

(57) ABSTRACT

A magnetically latching butterfly knife 10 having a magnetic latch 20 coupled thereto. The magnetic latch 20 is coupled to the magnetically latching butterfly knife 10. The magnetic latch 20 is coupled to at least one of the handle components 14 and/or 15. The magnetic latch 20 has at least one magnetic component 19 and at least one magnetic attracting surface 10A (i.e. magnet or metal surface) that are able to couple to at least one of the handle components 14 and 15. At least one magnetic component 19 and at least one magnetic attracting surface 10A magnetically attract and couple to each other to be able to provide open and closed latching operations for the butterfly knife 10. The magnetic latch 20 secures the first handle component 14 and the second handle component 15 in an open latched position and also in a closed latched position. The magnetic latch 20 may be configured and coupled to the butterfly knife 10 in many ways in order to provide the open latched and closed latched positions. Magnetic latches 20A, 20B, and 20C provide examples of such configurations. The magnetic latch 20 may include magnet(s) or magnetic component(s), magnetic attracting surface(s) (i.e. metal surface(s), etc.), and/or any combination thereof. A releasing component 50 or 60 is coupled to the butterfly knife 10 to allow the user to more easily move the knife 10 between the open latched and closed latched positions.

9 Claims, 6 Drawing Sheets

MAGNETICALLY LATCHING BUTTERFLY KNIFE

FIELD OF INVENTION

The present invention relates to a latched butterfly knife or a latch for a butterfly knife, and, in particular, to a magnetically latched butterfly knife or a magnetic latch for a butterfly knife.

BACKGROUND OF INVENTION AND BRIEF DESCRIPTION OF THE PRIOR ART

FIGS. 2 and 3 show a conventional prior art butterfly knife 2. The butterfly knife 2 generally has a knife blade 3, a first hinged component 4, a second hinged component 5, a first handle component 6, a second handle component 7, and a latch 8. The first hinged component 4 and the second hinged component 5 are attached to the knife blade 3. The first handle component 6 is hingedly coupled to the knife blade 3 at the first hinged component 4, and the second handle component 7 is hingedly coupled to the knife blade 3 at the second hinged component 5. The latch 8 includes a swinging portion 8A and a receiving slot 8B. The swinging portion 8A is hingedly coupled to the end of handle component 7 at point 8C, and the receiving slot 8B is located in the end of the handle component 6 as shown in FIGS. 2 and 3. The latch 8 works by having the swinging portion 8A fittingly engage into the receiving slot 8B to be able to lock the knife 2 into an open and usable position as shown in FIG. 2 and to also be able to lock the knife 2 into a closed and stored position as shown in FIG. 3. The butterfly knife 2 also has a handle stop 9 to help stabilize movement and skewing of the handle components 6 and 7 and the knife blade 3 when they are in the open and usable position by creating general cooperation and stability of the respective components at points A, B, and C. Other examples of butterfly type knives are disclosed in the following U.S. patents: U.S. Pat. Nos. 229,706; 365,086; 881,294; 1,270,727; 1,659,418; 1,665,955; 2,714,249; 4,047,298; 4,330,937; 4,364,174; 4,547,965; 4,555,822; 4,672,743, 4,722,140. These prior art patents are incorporated by reference herein.

A latching mechanism used in conjunction with a butterfly knife may be cumbersome to latch and/or unlatch, and the latch may become loose and not properly hold the knife in either the open or closed position (i.e. the latch may not be reliable). An improperly latched butterfly knife may be hazardous, dangerous, and cause potential injury to the user or others. Some of the prior art latches for butterfly knives require the use of moving part or parts making it more complex for the user to use. Such moving parts may be subjected to wear and tear leading to possible failure of the latch. Also, it is desired that these knives be easily and quickly opened or closed by the user, especially in instances such as emergency and/or combat situations. It is a continued need and desire to provide latches for butterfly knives or latching butterfly knives that are more simplistic, easier, and safer to use. Furthermore, devices or components for helping the user move a butterfly knife between the open latched and closed latched positions are continuously needed and desired as well.

Therefore, the present invention discloses and provides a magnetic latch for a butterfly knife and a magnetically latching butterfly knife, and the present invention overcomes the problems, disadvantages, and limitations of the prior art.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide a butterfly knife and/or a butterfly knife latch with a more simplistic, less cumbersome, and more reliable latching system.

It is another object of the invention to provide a butterfly knife with a latching system or a butterfly knife latch which provides further safety and less hazard to the user and others.

It is another object of the invention to provide a butterfly knife with a latching system or a butterfly knife latch that has less moving part or parts.

It is a further object of the invention to provide a butterfly knife with a latching system or a butterfly knife latch that is subjected to less wear and tear.

It is also another object of the invention to provide a butterfly knife with a latching system or a butterfly knife latch that is more simplistic, easier, safer, and more reliable to use and able to be moved relatively quickly between the open latched and closed latched positions.

It is a further object of the invention to provide further help or aid to the user to move a butterfly knife or a magnetically latched butterfly knife between an open latched and closed latched position.

The above objects and advantages of the invention are achieved by a magnetic latch for a butterfly knife. The magnetic latch for the butterfly knife has at least one magnetic component and at least one magnetic attracting surface (i.e. magnet or metal surface) that are able to couple to the handle components wherein the at least one magnetic component and at least one magnetic attracting surface magnetically attract and couple to each other to be able to provide open and closed latching operations for the butterfly knife.

The above objects and advantages of the invention are also achieved by a magnetically latching butterfly knife. The knife has a magnetic latch, and the magnetic latch includes at least one magnetic component and at least one magnetic attracting surface (i.e. magnet or metal surface) that couple to the handle components wherein the at least one magnetic component and at least one magnetic attracting surface magnetically attract and couple to each other to provide open and closed latching operations for the butterfly knife.

The above objects and advantages of the invention are further achieved by a method of using a magnetic latch for a butterfly knife that has a first handle component and a second handle component wherein the first and second handle components are able to be moved to an open position and a closed position. At least one magnetic component is attached to the first handle component. At least one magnetic component is magnetically coupled to the second handle component so that the first handle component and the second handle components are able to magnetically couple to each other in the open position and also in the closed position.

The above objects and advantages of the invention are also achieved by a method of using a magnetically latching butterfly knife. A butterfly knife is provided. A magnetic latch is coupled to at least a first handle component of the knife. The magnetic latch is used to magnetically couple the first handle component to a second handle component of the knife in either the open latched position or closed latched position.

The above objects and advantages of the invention are further achieved by providing a releasing component coupled to a magnetically latching butterfly knife in order to allow the user to more easily move the knife between the open latched and closed latched positions.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
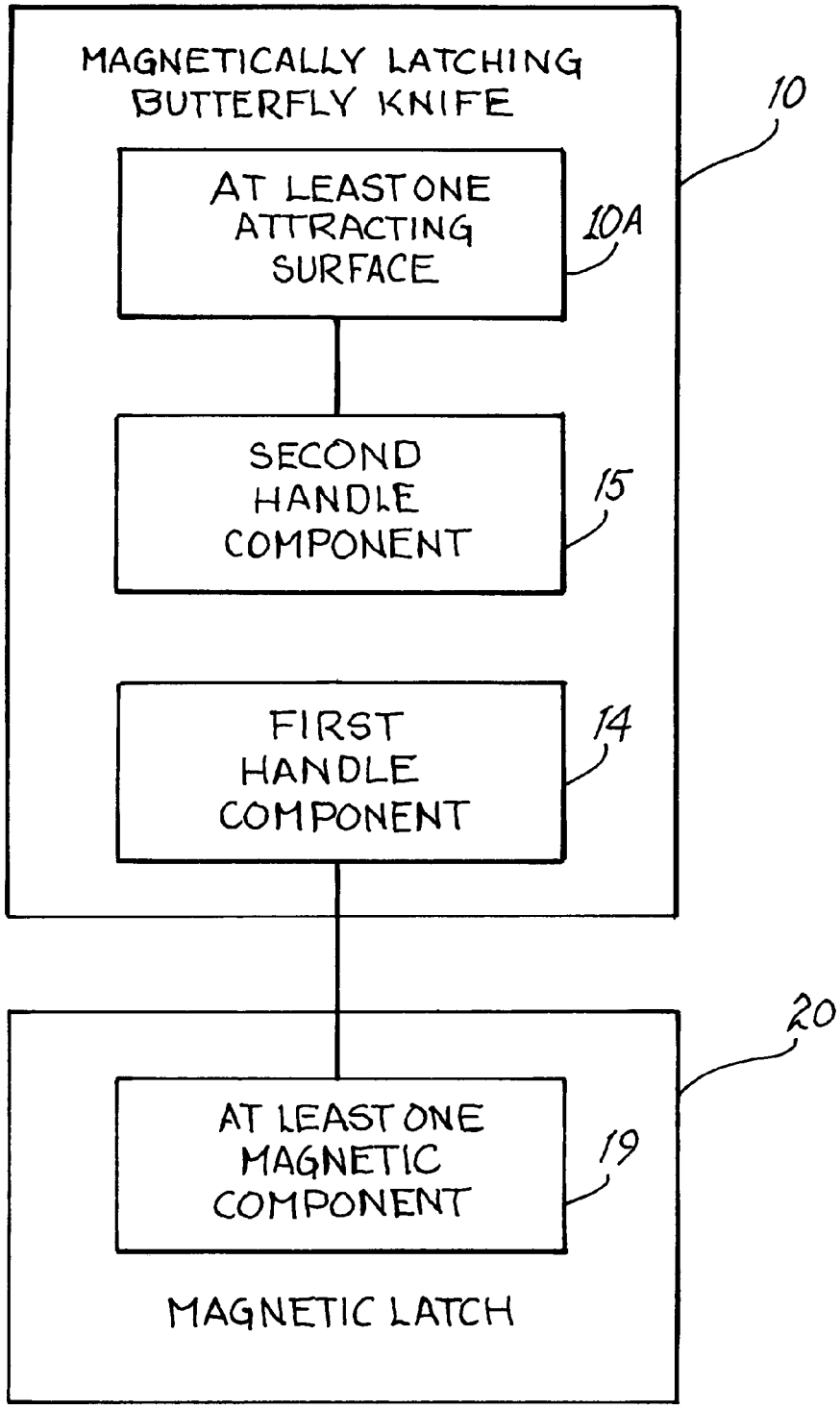
FIG. 1 is a general block diagram of the present invention magnetically latching butterfly knife wherein a magnetic latch is coupled thereto.
Figure 2:
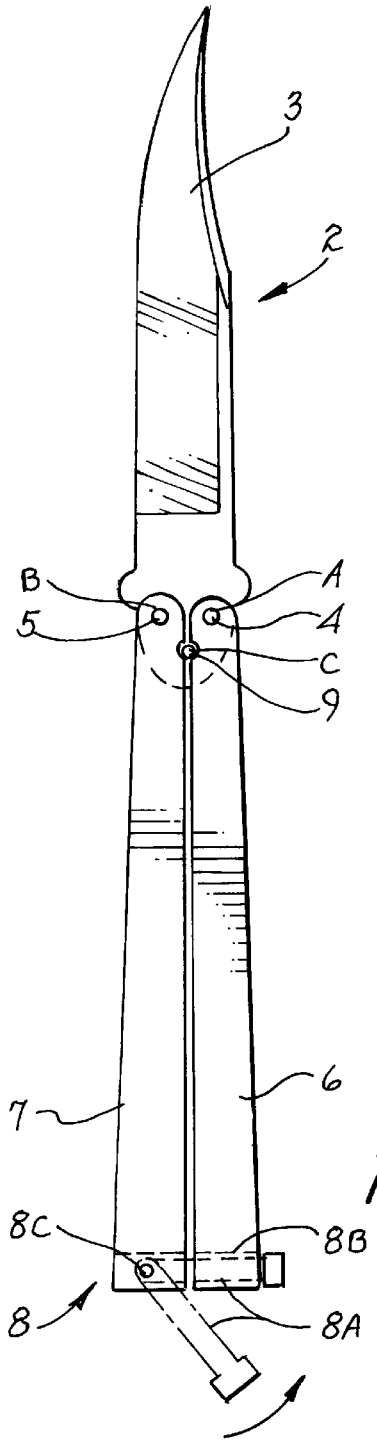
FIG. 2 (PRIOR ART)
FIG. 2 is a side view of a prior art butterfly knife with a conventional latch in the open latched and usable position.
Figure 3:
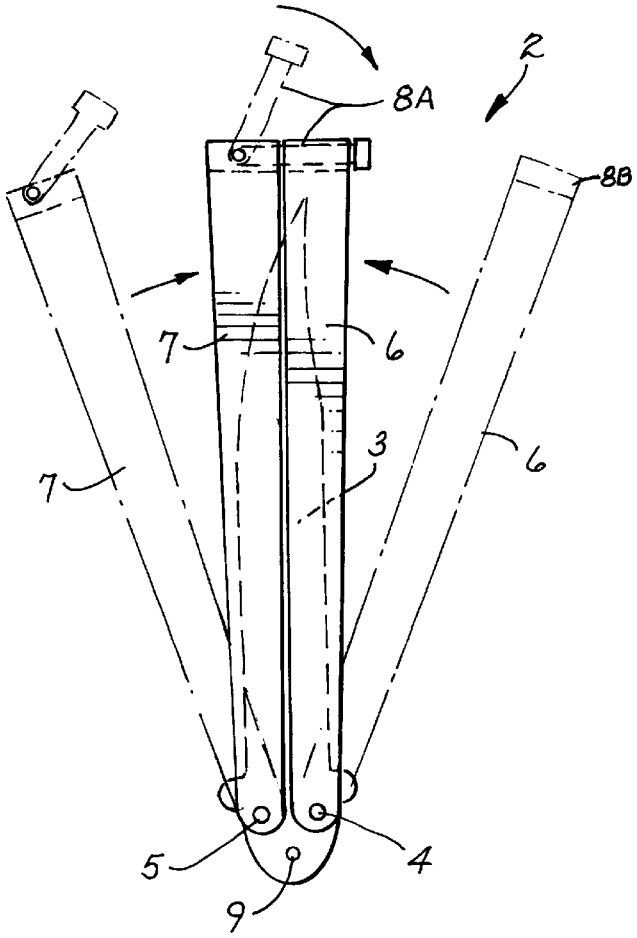
FIG. 3 (PRIOR ART)
FIG. 3 is a side view of a prior art butterfly knife with a conventional latch in the closed latched position.
Figure 14:
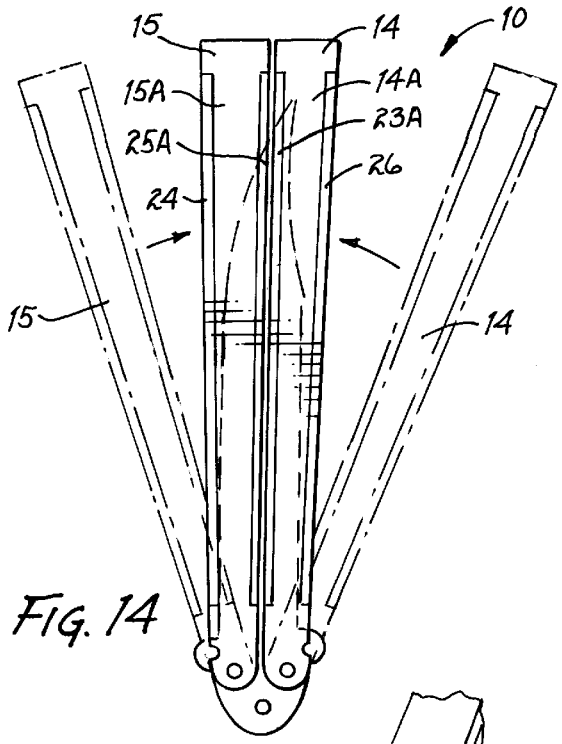
FIG. 14 is a side view of the present invention magnetically latching butterfly knife with a third embodiment magnetic latch wherein the knife is in the closed latched position.

The present invention is a magnetically latching butterfly knife 10 having a magnetic latch 20 coupled thereto. FIG. 1 is a block diagram showing the magnetic latch 20 coupled to the magnetically latching butterfly knife 10. FIGS. 4 to 17 show a magnetically latching butterfly knife 10. The magnetically latching butterfly knife 10 has a knife blade 11, a first hinged component 12, a second hinged component 13, a first handle component 14, a second handle component 15, and the magnetic latch 20 (i.e. such as magnetic latch 20A, 20B, or 20C). The first hinged component 12 and the second hinged component 13 are attached to the knife blade 11. The first handle component 14 is hingedly coupled to the knife blade 11 at the first hinged component 12, and the second handle component 15 is hingedly coupled to the knife blade 11 at the second hinged component 13. The magnetic latch 20 (i.e. such as magnetic latch 20A, 20B, or 20C) is coupled to at least one of the handle components. The magnetic latch 20 secures the first handle component 14 and the second handle component 15 in an open latched position (i.e. see FIGS. 4, 8, and 12 respectively showing butterfly knives with the magnetic latches 20A, 20B, and 20C) and also in a closed latched position (i.e. see FIGS. 6, 10, and 14 respectively showing butterfly knives with magnetic latches 20A, 20B, and 20C). The magnetic latch 20 may include magnet (s) or magnetic component(s), magnetic attracting surface(s) (i.e. metal surface(s), etc.), and/or any combination thereof This specification generally discloses three preferred embodiments of the present invention. However, the present invention is not in any way limited to just these embodiments, and any suitable embodiment for providing and using a magnetically latched butterfly knife or a magnetic latch for a butterfly knife may be used. For example, referring to FIG. 1, the at least one magnetic component 19 of the magnetic latch 20 may be a magnet while the at least one attracting surface 10A of the knife 10 may be a magnet or a metal surface on the knife 10.

Figure 4:
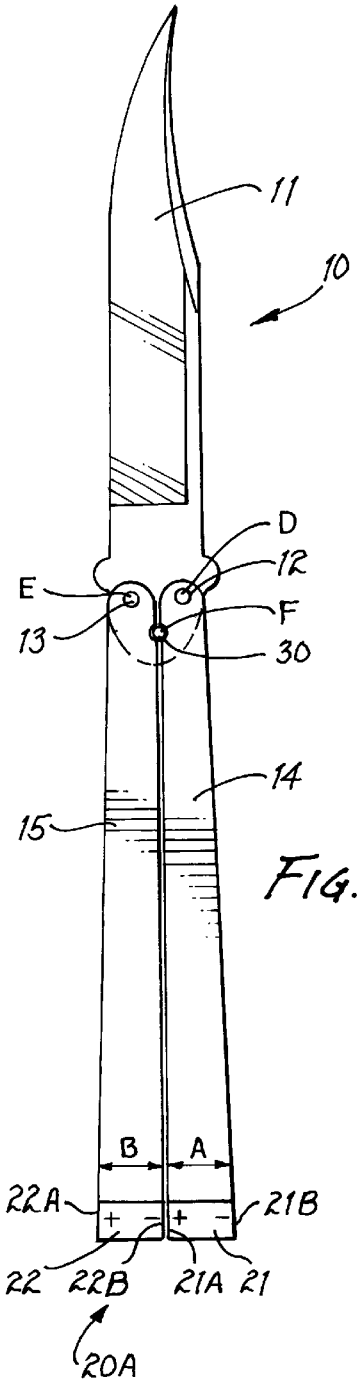
FIG. 4 is a side view of the present invention magnetically latching butterfly knife with a first embodiment magnetic latch wherein the knife is in the open latched position.
Figure 6:
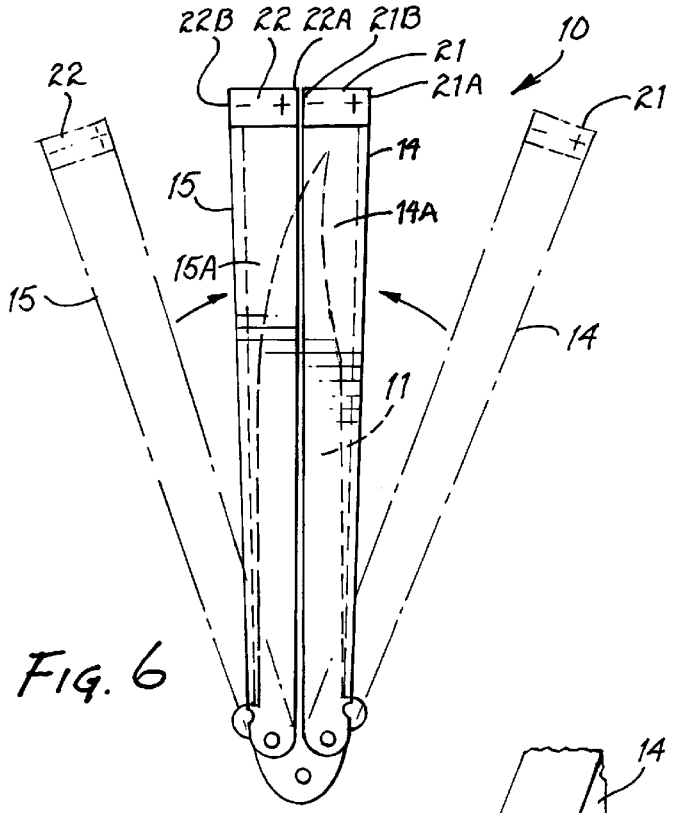
FIG. 6 is a side view of the present invention magnetically latching butterfly knife with a first embodiment magnetic latch wherein the knife is in the closed latched position.
Figure 7:
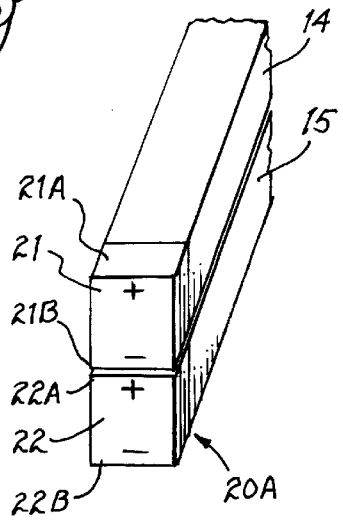
FIG. 7 is a partial rear perspective view of the handle components of the closed position knife of FIG. 6 and the first embodiment latch coupled thereto.
Figure 5:
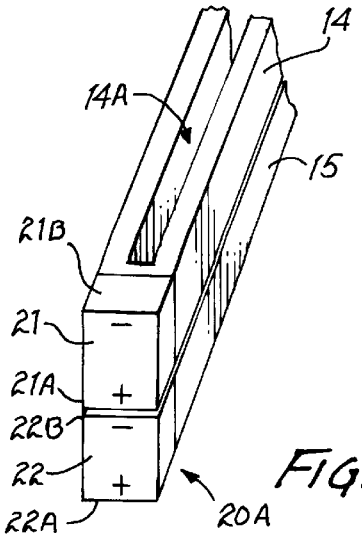
FIG. 5 is a partial rear perspective view of the handle components of the open position knife of FIG. 4 and the first embodiment latch coupled thereto.

FIGS. 4 to 7 show a butterfly knife 10 with a first embodiment magnetic latch 20A. The magnetic latch 20A has two magnetic components 21 and 22. The first magnetic component 21 is attached to the first handle component 14, and the second magnetic component 22 is attached to the second handle component 15. Referring to FIGS. 4 to 7, the first magnetic component 21 spans a width A of the first handle component 14, and the second magnetic component 22 spans a width B of the second handle component 15. The first and second magnetic components 21 and 22 are positioned and mounted in a way so that their respective magnetic side surfaces 21A, 21B and 22A, 22B are exposed at the sides of the respective handle components 14 and 15 to be able to at least contact and magnetically couple to each other to form contacting surface pair 21A, 22B when the knife 10 is in the open position as shown in FIGS. 4 and 5 and form contacting surface pair 21B, 22A when the knife is in the closed position as shown in FIGS. 6 and 7.

FIG. 4 shows that the butterfly knife 10 is in the open position when the first and second handle components 14 and 15 are extended away from the knife blade 11. Referring to FIGS. 4 and 5, the magnetic side surface 21 A of magnetic component 21 and the magnetic side surface 22B of magnetic component 22 attract and couple to each other such that the first and second handle components 14 and 15 are in an open latched position. When the knife 10 is in the open and usable position, the handle stop 30 helps stabilize movement and skewing of the handle components 14 and 15 and the knife blade 11 by creating general cooperation and stability of the respective components at points D, E, and F. FIG. 6 shows that the butterfly knife 10 is in the closed position when the first and second handle components 14 and 15 are moved to close and house the knife blade 11 therein. The handle components 14 and 15 have at least hollow portions 14A and 15A to at least receive the blade 11 as shown in FIG. 6. Referring to FIGS. 6 and 7, the magnetic side surface 21B of magnetic component 21 and the magnetic side surface 22A of magnetic component 22 attract and couple to each other such that the first and second handle components 14 and 15 are in a closed latched position.

FIGS. 4 to 7 show that the polarity and positioning of the magnetic components 21 and 22 are configured so that the appropriate handle component surfaces attract and couple to each other to provide the open and closed latched positions of the knife 10. FIGS. 4 and 5 show that the magnetic surface 21 A has a positive magnetic polarity while magnetic surface 22B has a negative magnetic polarity wherein the positive and negative polarities attract to each other to provide the open latched position. FIGS. 6 and 7 show that the magnetic surface 21B has a negative magnetic polarity while magnetic surface 22A has a positive magnetic polarity wherein the negative and positive polarities attract to each other to provide the closed latched position.

FIGS. 8 to 11 show a butterfly knife 10 with a second embodiment magnetic latch 20B. The magnetic latch 20B has four magnetic components 23, 24, 25, and 26 that are placed at ends of the edges of the handle components 14 and 15. The first handle component 14 has an edge 33 and an edge 34, and the second handle component 15 has an edge 35 and 36. The first magnetic component 23 is attached to and placed/exposed at an edge end 43 of edge 33 of the first handle component 14, and the second magnetic component 24 is attached to and placed/exposed at an edge end 44 of edge 34 of the first handle component 14. The third magnetic component 25 is attached to and placed/exposed at an edge end 45 of edge 35 of the second handle component 15, and the fourth magnetic component 26 is attached to and placed/exposed at an edge end 46 of edge 36 of the second handle component 15.

Figure 8:
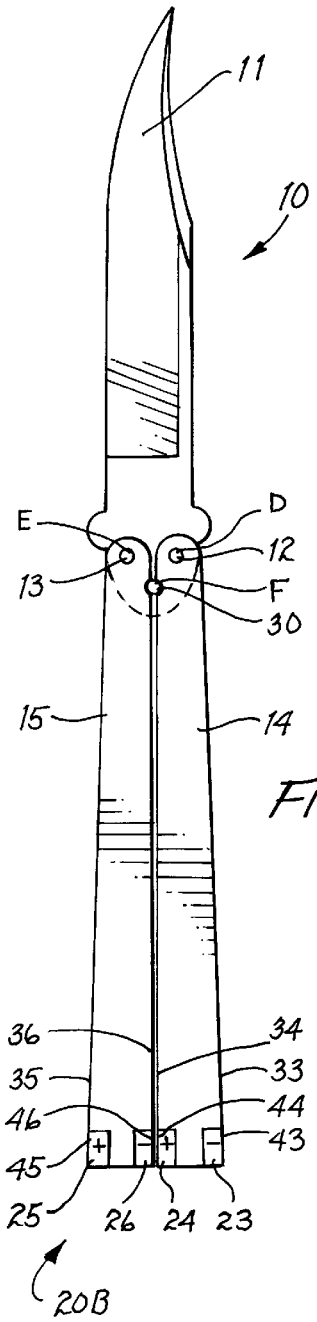
FIG. 8 is a side view of the present invention magnetically latching butterfly knife with a second embodiment magnetic latch wherein the knife is in the open latched position.
Figure 10:
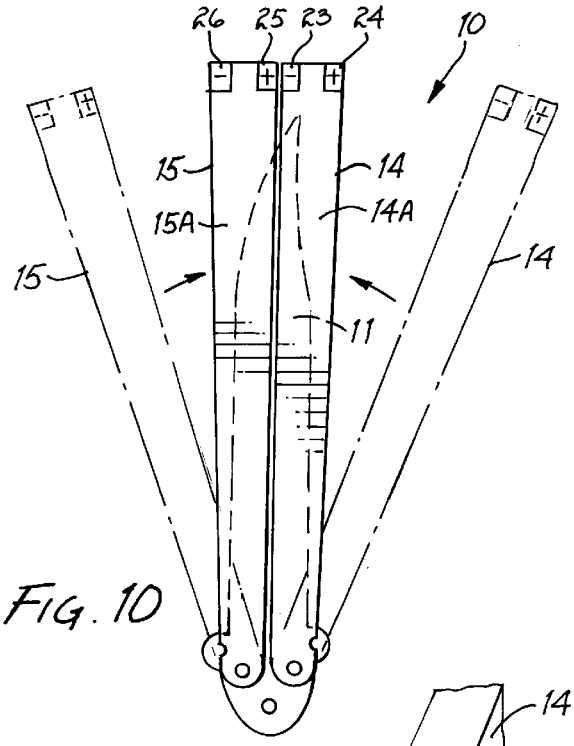
FIG. 10 is a side view of the present invention magnetically latching butterfly knife with a second embodiment magnetic latch wherein the knife is in the closed latched position.
Figure 11:
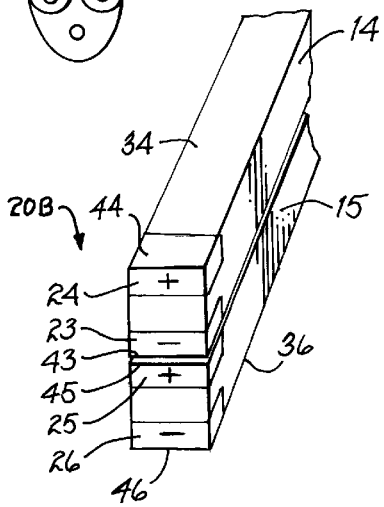
FIG. 11 is a partial rear perspective view of the handle components of the closed position knife of FIG. 10 and the second embodiment latch coupled thereto.
Figure 9:
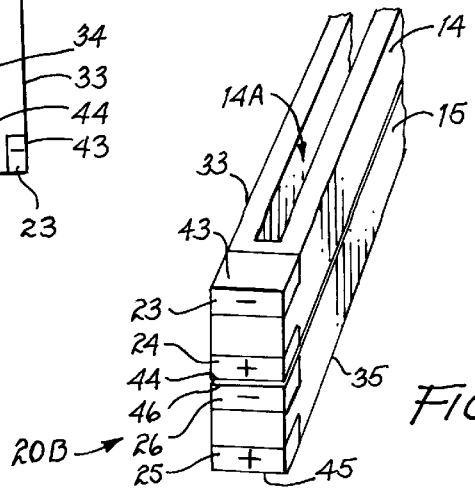
FIG. 9 is a partial rear perspective view of the handle components of the open position knife of FIG. 8 and the second embodiment latch coupled thereto.
Figure 12:
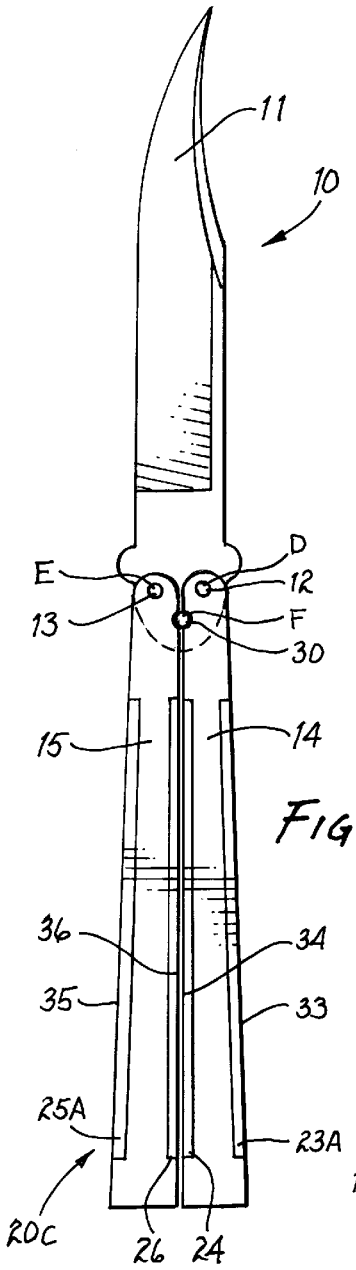
FIG. 12 is a side view of the present invention magnetically latching butterfly knife with a third embodiment magnetic latch wherein the knife is in the open latched position.

FIG. 8 shows that the butterfly knife 10 is in the open position when the first and second handle components 14 and 15 are extended away from the knife blade 11. Referring to FIGS. 8 and 9, the second and fourth magnetic components 24 and 26 are respectively positioned and mounted to the first and second handle components 14 and 15 in a way so that they are able to at least contact and magnetically couple to each other when the handle components 14 and 15 are placed in the open position. The magnetic components 24 and 26 attract and couple to each other such that the first and second handle components 14 and 15 are in an open latched position. When the knife 10 is in the open and usable position, the handle stop 30 helps stabilize movement and skewing of the handle components 14 and 15 and the knife blade 11 by creating general cooperation and stability of the respective components at points D, E, and F. FIG. 10 shows that the butterfly knife 10 is in the closed position when the first and second handle components 14 and 15 are moved to close and house the knife blade 11 therein. The handle components 14 and 15 have at least hollow portions 14A and 15A to at least receive the blade 11 as shown in FIG. 10. Referring to FIGS. 10 and 11, the first and third magnetic components 23 and 25 attract and couple to each other such that the first and second handle components 14 and 15 are in a closed latched position.

FIGS. 8 to 11 show that the polarity and positioning of the magnetic components 23, 24, 25, and 26 are configured so that the appropriate handle component surfaces attract and couple to each other to provide the open and closed latched positions for the knife 10. FIGS. 8 and 9 show that the magnetic component 24 has a positive magnetic polarity while magnetic component 26 has a negative magnetic polarity wherein the positive and negative polarities attract to each other to provide the open latched position. FIGS. 10 and 11 show that the magnetic component 23 has a negative magnetic polarity while magnetic component 25 has a positive magnetic polarity wherein the negative and positive polarities attract to each other to provide the closed latched position.

Figure 15:
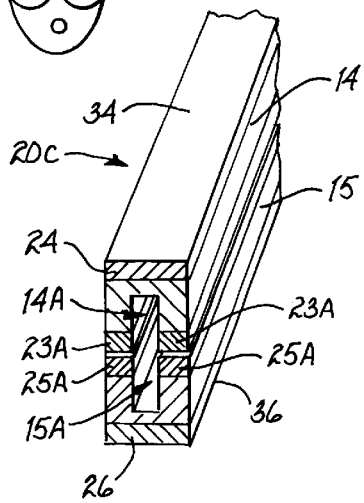
FIG. 15 is a partial rear perspective and cross-sectional view of the handle components of the closed position knife of FIG. 14 and the third embodiment latch coupled thereto.
Figure 13:
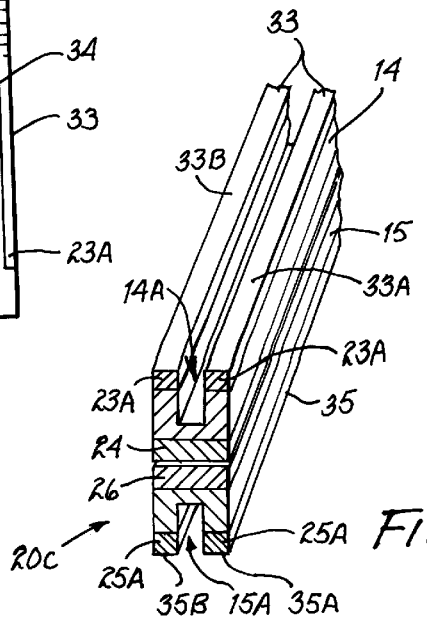
FIG. 13 is a partial rear perspective and cross-sectional view of the handle components of the open position knife of FIG. 12 and the third embodiment latch coupled thereto.

FIGS. 12 to 15 show a butterfly knife 10 with a third embodiment magnetic latch 20C. The magnetic latch 20C has magnetic components 24 and 26 that are respectively placed along edges 34 and 36 and a plurality of magnetic components 23A and 25A that are respectively placed along the edges 33 and 35 of the handle components 14 and 15. The third embodiment latch 20C is identical to and used in the same manner as the second embodiment latch 20B except that the magnetic components 23A, 24, 25A, and 26 are placed along the respective edges 33, 34, 35, and 36 of the handle components instead of at the edge ends 43, 44, 45, and 46 so that the overall magnetic attracting surface areas are increased for the handle components 14 and 15. Since the magnetic components are placed along the edges instead of at the edge ends of the handle components 14 and 15, the generally same magnetic components 24 and 26 may be used along the non-hollow edges 34 and 36 of the handle components 14 and 15. The plurality of magnetic components 23A and 25A placed along the hollow portion edges 33 and 35 need to be spaced along the lengths of both respective edges 33A, 33B and 35A, 35B as shown in FIGS. 13 and 15 so that the magnetic attracting surface areas along the edges 33 and 35 are increased.

Figure 17:
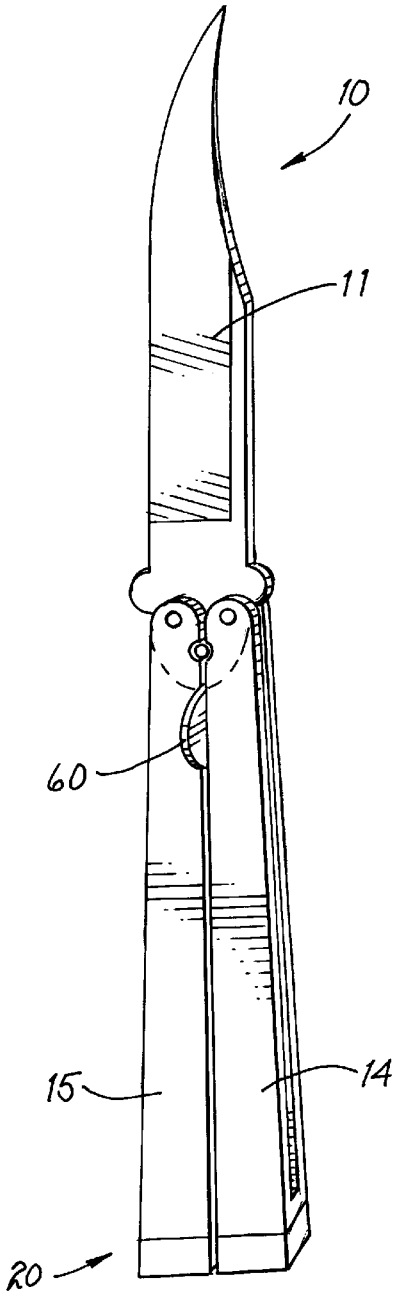
FIG. 17 is a perspective side view of a second embodiment releasing component coupled to a handle component of the present invention magnetically latching butterfly knife.
Figure 16:
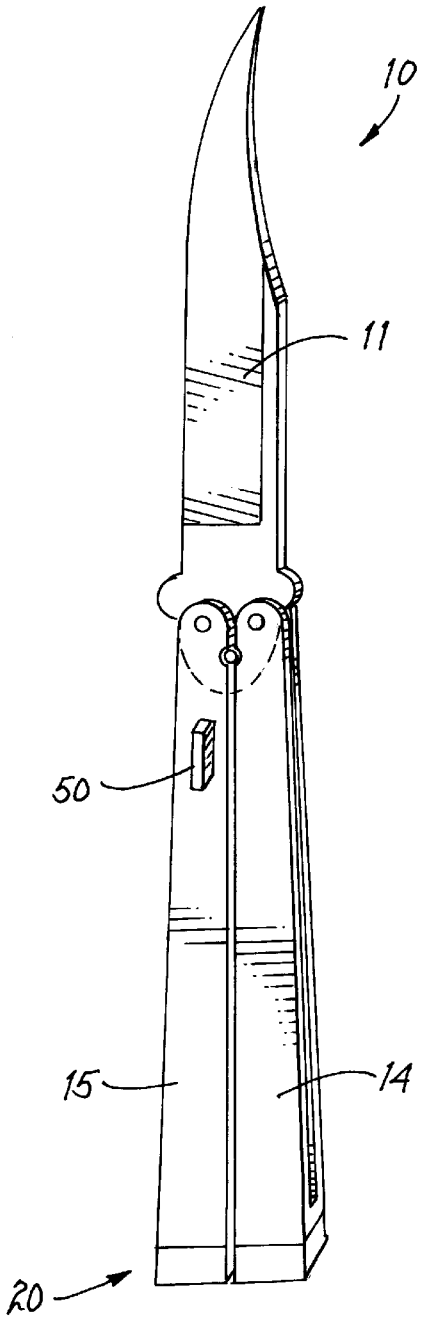
FIG. 16 is a perspective side view of a first embodiment releasing component coupled to a handle component of the present invention magnetically latching butterfly knife.

In conjunction with the present invention, a releasing component 50 or 60 is coupled to at least one side of at least one handle component (i.e. handle component 15 and/or 14) as shown in FIGS. 16 and 17. Releasing components 50 or 60 assist a user of the knife 10 in releasing the handle components 14 and 15 that are coupled to each other from the open or closed latched position. FIG. 16 shows a protuberance releasing component 50 that extends from a handle component 15 and/or 14. The user contacts the protuberance portion of the component 50 with at least one finger (i.e. preferably thumb), and the force applied thereat directs one handle component away from the other. FIG. 17 shows a detent/notch releasing component 60 that is embedded into the handle component 15 and/or 14. The user places his/her at least one finger (i.e. preferably thumb) into the detent/notch portion of the component 60, and the force applied thereat directs one handle component away from the other. The protuberance and detent/notch portions are located on or in the handle component 15 and/or 14 to accommodate both right and left hand usage of the knife 10.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated. The present invention is not in any way limited to the specific magnetic latches, magnetic components, and releasing components and corresponding placements and configurations disclosed in the specification, and, any suitable magnetic latch, magnetic component, releasing component, placement, and configuration may be used in conjunction with the present invention.

What is claimed is:

1. A magnetic latch for a butterfly knife has a first handle component and a second handle component wherein the first and second handle components are able to be moved to an open position and a closed position comprising:

at least one magnetic component attachable to the first handle component that magnetically couples to the second handle component so that the first handle component and the second handle component magnetically couple to each other in the open position and also in the closed position, and at least one magnetically attracting surface attached to the second handle component wherein the at least one magnetically attracting surface is attractable to the at least one magnetic component, wherein the at least one magnetically attracting surface is at least another magnetic component attachable to the second handle component, wherein the at least one magnetic component is a first magnetic component and the at least another magnetic component is a second magnetic component, wherein the first magnetic component has a first opening surface and a first closing surface and the second magnetic component has a second opening surface and a second closing surface, wherein the first opening surface couples to the second opening surface to allow the butterfly knife to be secured in the open position, and wherein the first closing surface couples to the second closing surface to allow the butterfly knife to be secured in the closed position.

2. The magnetic latch according to claim 1 wherein the first magnetic component is positionable and mountable to span a first width of the first handle component and wherein the second magnetic component is positionable and mountable to span a second width of the second handle component.

3. The magnetic latch according to claim 1:

wherein the first opening surface is a positive opening surface and the second opening surface is a negative opening surface and wherein the positive opening surface and the negative opening surface attract and couple to each other to allow the butterfly knife to be secured in the open position, and wherein the first closing surface is a negative closing surface and the second closing surface is a positive closing surface and wherein the negative closing surface and the positive closing surface attract and couple to each other to allow the butterfly knife to be secured in the closed position.

4. A magnetic latch for a butterfly knife has a first handle component and a second handle component wherein the first and second handle components are able to be moved to an open position and a closed position comprising:

at least one magnetic component attachable to the first handle component that magnetically couples to the second handle component so that the first handle component and the second handle component magnetically couple to each other in the open position and also in the closed position, and at least one magnetically attracting surface attached to the second handle component wherein the at least one magnetically attracting surface is attractable to the at least one magnetic component, wherein the at least one magnetic component is an opening magnet and a closing magnet and wherein the at least one magnetically attracting surface is an opening attracting surface and a closing attracting surface, and wherein the opening magnet attracts and couples to the opening attracting surface to place the butterfly knife in the open position and wherein the closing magnet attracts and couples to the closing attracting surface to place the butterfly knife in the closed position.

5. A magnetic latch for a butterfly knife has a first handle component and a second handle component wherein the first and second handle components are able to be moved to an open position and a closed position comprising:

at least one magnetic component attachable to the first handle component that magnetically couples to the second handle component so that the first handle component and the second handle component magnetically couple to each other in the open position and also in the closed position, and at least one magnetically attracting surface attached to the second handle component wherein the at least one magnetically attracting surface is attractable to the at least one magnetic component, wherein the at least one magnetic component is an opening magnet and the first handle component further has a closing attracting surface and wherein the at least one magnetically attracting surface is a closing magnet and the second handle component further comprises an opening attracting surface, and wherein the opening magnet attracts and couples to the opening attracting surface to place the butterfly knife in the open position and wherein the closing magnet attracts and couples to the closing attracting surface to place the butterfly knife in the closed position.

6. A magnetic latch for a butterfly knife has a first handle component and a second handle component wherein the first and second handle components are able to be moved to an open position and a closed position comprising:

at least one magnetic component attachable to the first handle component that magnetically couples to the second handle component so that the first handle component and the second handle component magnetically couple to each other in the open position and also in the closed position, and at least one magnetically attracting surface attached to the second handle component wherein the at least one magnetically attracting surface is attractable to the at least one magnetic component, wherein the at least one magnetic component is a closing magnet and the first handle component further has an opening attracting surface and wherein the at least one magnetically attracting surface is an opening magnet and the second handle component further comprises a closing attracting surface, and wherein the opening magnet attracts and couples to the opening attracting surface to place the butterfly knife in the open position and wherein the closing magnet attracts and couples to the closing attracting surface to place the butterfly knife in the closed position.

7. A magnetically latching butterfly knife comprising:

a knife blade, a first hinged component and a second hinged component coupled to the knife blade, a first handle component hingedly coupled to the first hinged component, a second handle component hingedly coupled to the second hinged component, a magnetic latch coupled to at least the first handle component wherein the magnetic latch secures the first handle component and the second handle component in an open latched position and also in a closed latched position, wherein the magnetic latch further comprises at least one magnetic component attachable to the first handle component and able to magnetically couple to the second handle component so that the first handle component and the second handle components are able to magnetically couple to each other in the open latched position and also in the closed latched position, and at least one magnetically attracting surface attached to the second handle component wherein the at least one magnetically attracting surface is attractable to the at least one magnetic component, wherein the at least one magnetically attracting surface is at least another magnetic component attachable to the second handle component, wherein the at least one magnetic component is a first magnetic component and the at least another magnetic component is a second magnetic component, wherein the first magnetic component has a first opening surface and a first closing surface and the second magnetic component has a second opening surface and a second closing surface, wherein the first opening surface couples to the second opening surface to allow the butterfly knife to be secured in the open latched position, and wherein the first closing surface couples to the second closing surface to allow the butterfly knife to be secured in the closed latched position.

8. The magnetically latching butterfly knife according to claim 7 wherein the first magnetic component is positionable and mountable to span a first width of the first handle component and wherein the second magnetic component is positionable and mountable to span a second width of the second handle component.

9. The magnetically latching butterfly knife according to claim 8:

wherein the first opening surface is a positive opening surface and the second opening surface is a negative opening surface and wherein the positive opening surface and the negative opening surface attract and couple to each other to allow the butterfly knife to be secured in the open latched position, and wherein the first closing surface is a negative closing surface and the second closing surface is a positive closing surface and wherein the negative closing surface and the positive closing surface attract and couple to each other to allow the butterfly knife to be secured in the closed latched position.

* * * * *